US009564305B2

(12) United States Patent
Berkout et al.

(10) Patent No.: US 9,564,305 B2
(45) Date of Patent: Feb. 7, 2017

(54) ION FUNNEL FOR EFFICIENT TRANSMISSION OF LOW MASS-TO-CHARGE RATIO IONS WITH REDUCED GAS FLOW AT THE EXIT

(71) Applicant: Smiths Detection Inc., Edgewood, MD (US)

(72) Inventors: Vadym Berkout, Rockville, MD (US); Jan Hendrikse, Whitby (CA)

(73) Assignee: Smiths Detection Inc., Edgewood, MD (US)

( * ) Notice: Subject to any disclaimer, the term of this patent is extended or adjusted under 35 U.S.C. 154(b) by 0 days.

(21) Appl. No.: 14/445,595

(22) Filed: Jul. 29, 2014

(65) Prior Publication Data

US 2016/0035556 A1 Feb. 4, 2016

(51) Int. Cl.
*H01J 49/06* (2006.01)

(52) U.S. Cl.
CPC ..... *H01J 49/066* (2013.01)

(58) Field of Classification Search
CPC ..... H01J 49/06; H01J 49/062; H01J 49/065; H01J 49/066; H01J 49/067; H01J 49/068; H01J 49/24
USPC ..... 250/281, 282, 290, 292
See application file for complete search history.

(56) References Cited

U.S. PATENT DOCUMENTS 6,107,628 A * 8/2000 Smith ..... H01J 49/066 250/292
7,351,964 B2 * 4/2008 Tolmachev ..... H01J 49/066 250/281
7,838,826 B1 * 11/2010 Park ..... G01N 27/622 250/281
7,851,752 B2 * 12/2010 Kim ..... H01J 49/066 250/292
8,222,597 B2 7/2012 Kim et al.
(Continued)

FOREIGN PATENT DOCUMENTS

WO 2013098598 A1 7/2013

OTHER PUBLICATIONS

Scott A. Shaffer, Aleksey Tolmachev, David C. Prior, Gordon A. Anderson, Harold R. Udseth, and Richard D. Smith; Characterization of an Improved Electrodynamic Ion Funnel Interface for Electrospray Ionization Mass Spectrometry; Analytical Chemistry; vol. 71, No. 15; Aug. 1, 1999; pp. 2957-2964.
(Continued)

*Primary Examiner* — David E Smith
(74) *Attorney, Agent, or Firm* — Advent, LLP

(57) ABSTRACT

A sample inlet device and methods for use of the sample inlet device are described that include an ion funnel having a plurality of electrodes with apertures arranged about an axis extending from an inlet of the ion funnel to an outlet of the ion funnel, the ion funnel including a plurality of spacer elements disposed coaxially with the plurality of electrodes, each of the plurality of spacer elements being positioned between one or two adjacent electrodes, each of the plurality of spacer elements having an aperture with a diameter that is greater than a diameter of each adjacent electrode. The ion funnel is configured to pass an ion sample through the apertures of the electrodes and the spacer elements to additional portions of a detection system, such as to a mass analyzer system and detector.

22 Claims, 8 Drawing Sheets

(56) References Cited

U.S. PATENT DOCUMENTS

| | | | | |
|---|---|---|---|---|
| 8,288,717 | B2 * | 10/2012 | Park | G01N 27/622 250/281 |
| 8,324,565 | B2 | 12/2012 | Mordehai et al. | |
| 2005/0092918 | A1 * | 5/2005 | Smith | G01N 27/622 250/288 |
| 2009/0294662 | A1 * | 12/2009 | Belov | H01J 49/4235 250/291 |
| 2012/0043460 | A1 | 2/2012 | Wouters et al. | |
| 2012/0298853 | A1 * | 11/2012 | Kurulugama | H01J 49/065 250/282 |
| 2013/0175441 | A1 | 7/2013 | Zanon et al. | |

OTHER PUBLICATIONS

Jason S. Page, Aleksey V. Tolmachev, Keqi Tang, and Richard D. Smith; Theoretical and Experimental Evaluation of the Low m/z Transmission of an Electrodynamic Ion Funnel; American Society for Mass Spectrometry; Published by Elsevier Inc.; 2006; pp. 586-592.

Yehia Ibrahim, Keqi Tang, Aleksey V. Tolmachev, Alexandre A. Shvartsburg, and Richard D. Smith; Improving Mass Spectrometer Sensitivity Using a High-Pressure Electrodynamic Ion Funnel Interface; American Society for Mass Spectrometry; Published by Elsevier Inc.; 2006; pp. 1299-1305.

Paul Momoh, Michael Ugarov, Mark Werlich, Tom Knotts, Alex Mordehai; Optimization of the Electrodynamic Ion Funnel for Enhanced Low Mass Transmission; Agilent Technologies; Proc. of Am. Soc. Mass Spectrom Conf.; Salt Lake City, Utah; 2010.

International Search Report and Written Opinion dated Nov. 27, 2015 for PCT/US2015/042616.

Momoh, Paul et al., "Optimizatiion of the Electrodynamic Ion Funnel for Enhanced Low Mass Transmission: Influence of Funnel Operational Pressure on Ion Transmission", Agilent Technologies, Santa Clara, CA, ASMS 2010, Poster 679.

Tang, Keqi et al., "High-Sensitivity Ion Mobility Spectrometry/Mass Spectrometry Using Electrodynamic Ion Funnel Interfaces", Anal. Chem. May 15, 2005, 77(10), 3330-3339.

Kelly, Ryan T. et al., "The ion funnel: Theory, implementations, and applications", Mass Spectrometry Reviews, vol. 29, Issue 2, Mar./Apr. 2010, 294-312.

* cited by examiner

ION FUNNEL FOR EFFICIENT TRANSMISSION OF LOW MASS-TO-CHARGE RATIO IONS WITH REDUCED GAS FLOW AT THE EXIT

BACKGROUND

Atmospheric pressure ionization refers to an analytical technique that can be used to generate and identify ionized material, such as molecules and atoms, at or near atmospheric pressure. After ionization, a detection technique, such as mass spectrometry, can be used for spectral analysis of the ionized material. For instance, mass spectrometers (MS) separate ions in a mass analyzer with respect to mass-to-charge ratio, where ions are detected by a device capable of detecting charged particles. The signal from a detector in the mass spectrometer is then processed into spectra of the relative abundance of ions as a function of the mass-to-charge ratio. The atoms or molecules are identified by correlating the identified masses with known masses or through a characteristic fragmentation pattern. In general, atmospheric pressure ionization techniques allow use of selective chemistry and direct surface analysis for the preparation and detection of a sample. For example, atmospheric pressure ionization and detection techniques can be used for military and security applications, e.g., to detect drugs, explosives, and so forth. Atmospheric pressure ionization and detection techniques can also be used in laboratory analytical applications, and with complementary detection techniques such as mass spectrometry, liquid chromatography, and so forth.

SUMMARY

A sample inlet device and methods for use of the sample inlet device are described that include an ion funnel having a plurality of electrodes with apertures arranged about an axis extending from an inlet of the ion funnel to an outlet of the ion funnel, the ion funnel including a plurality of spacer elements disposed coaxially with the plurality of electrodes, each of the plurality of spacer elements being positioned proximal to one or two adjacent electrodes. In implementations, each of the plurality of spacer elements defines an aperture with a diameter that is greater than a diameter of an aperture defined by each respective adjacent electrode. The ion funnel is configured to pass an ion sample through the apertures of the electrodes and the spacer elements to additional portions of a detection system, such as to a mass analyzer system and detector. Additionally, a sample detection device may include an ion guide, a mass analyzer, a detector, at least one vacuum pump (e.g., a low vacuum pump, a high vacuum pump, etc). In an implementation, a process for utilizing the sample inlet device that employs the techniques of the present disclosure includes producing a sample of ions from an ion source, receiving the sample of ions at an ion funnel having a plurality of spacer elements disposed coaxially with a plurality of electrodes, and transferring the sample of ions from the ion funnel to a detection unit.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference number in different instances in the description and the figures may indicate similar or identical items.

DETAILED DESCRIPTION

Figure 1:
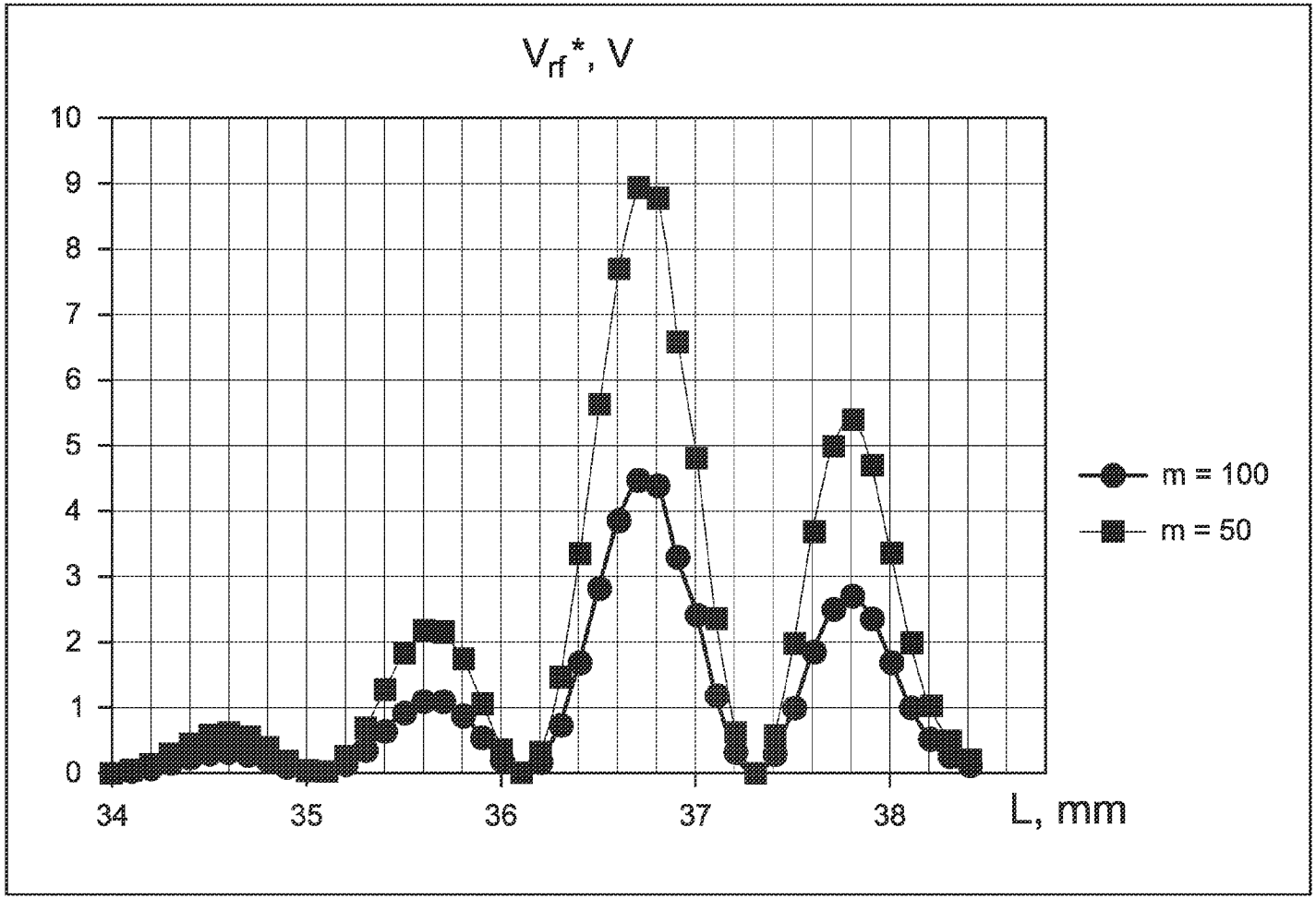
FIG. 1 is a graph of effective potential calculations at a central axis of an ion funnel for two mass-to-charge ratio (m/z) ions, in accordance with example implementations of the present disclosure.

Mass spectrometers (MS) operate in a vacuum and separate ions with respect to the mass-to-charge ratio. In some embodiments using a mass spectrometer, a sample, which may be solid, liquid, or gas, is ionized and analyzed. The ions are separated in a mass analyzer according to mass-to-charge ratio and are detected by a detector capable of detecting charged particles. The signal from the detector is then processed into the spectra of the relative abundance of ions as a function of the mass-to-charge ratio. The atoms or molecules are identified by correlating the identified masses with known masses or through a characteristic fragmentation pattern.

Atmospheric pressure ionization techniques allow use of selective chemistry and direct surface analysis. In order to analyze the ions produced by atmospheric pressure ionization techniques, the ions should be transitioned from atmospheric or near atmospheric pressure to vacuum or near vacuum pressures. There are significant technical challenges to providing efficient transfer of low abundance analyte ions of interest from atmosphere into a vacuum environment, such as the environment of a miniature mass analyzer. The technical challenges can be related to size and weight limitations of portable detection systems, which severely limit the choice of system components, such as vacuum pumps. Differential pumping can be used to reduce the pressure from atmospheric (e.g., 760 Torr) to the pressure at which a mass spectrometer can analyze the ions (e.g., $10^{-3}$ Torr or lower), which can be applied in a multi-stage pressure reduction process. The fluid flow rate from atmosphere should be at least 0.15 L/min through an orifice or a small capillary to avoid significant ion losses and clogging. A first stage vacuum manifold (e.g., including a small diaphragm pump) with such intake flows results in pressures in the order of a few Torr in this region.

Figure 2:
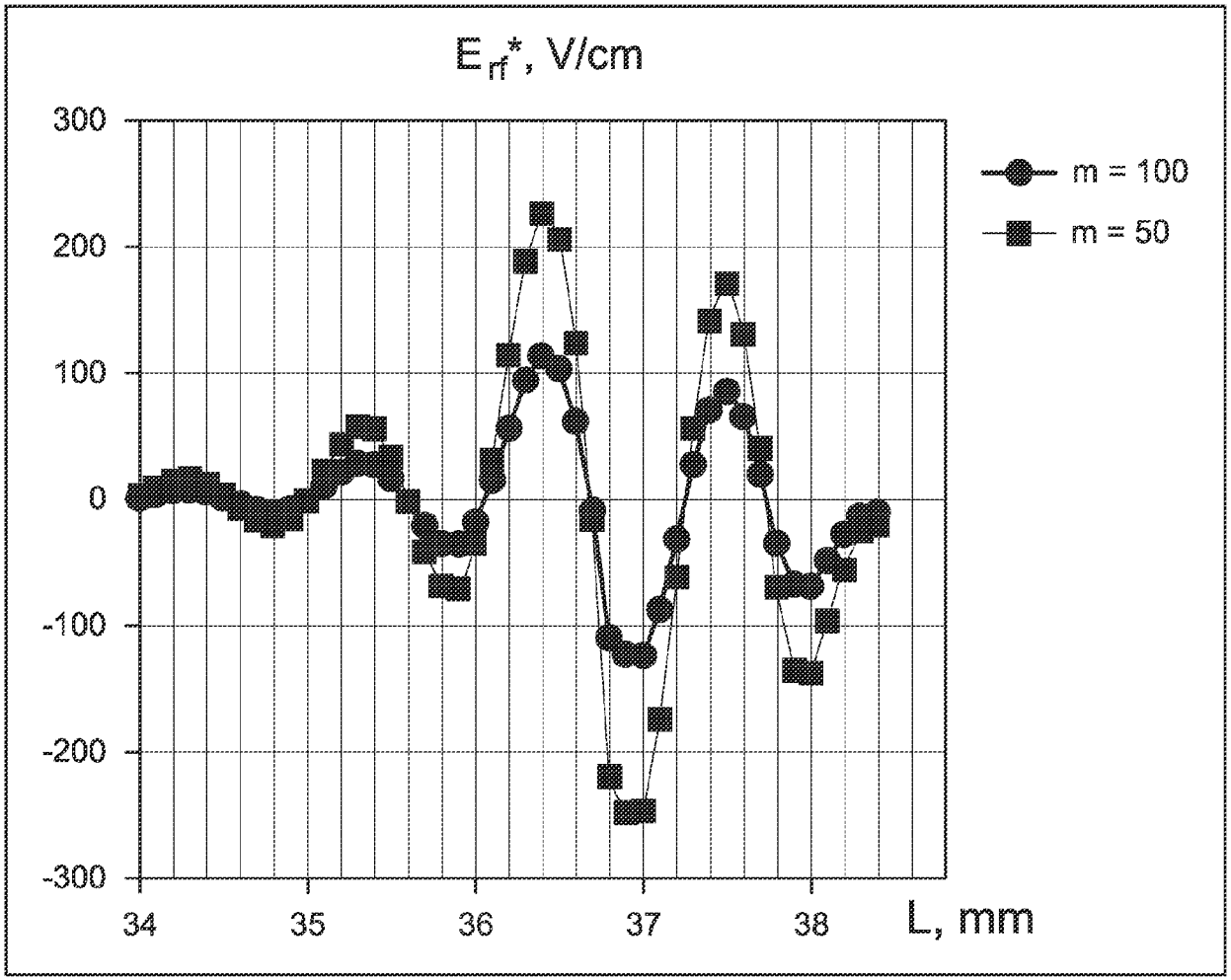
FIG. 2 is a graph of effective electric fields corresponding to the effective potential calculations at the central axis of the ion funnel shown in FIG. 1, in accordance with example implementations of the present disclosure.

At pressures within a few Torr, an ion funnel can be utilized to confine an expanding ion plum from a sample passing through an inlet capillary. The ion funnel (e.g., as described in U.S. Pat. No. 6,107,628) comprises of a stack of closely spaced ring electrodes with gradually decreased inner diameters and out-of-phase radio frequency (RF) potentials applied to adjacent electrodes. An RF field applied to the funnel electrodes creates an effective potential which confines ions radially in the presence of a buffer gas, whereas a direct current (DC) axial electric field gradient moves the ions from the inlet capillary toward the exit electrode. Resistors are generally placed between neighboring electrodes to enable a linear DC potential gradient, and capacitors are utilized to decouple the RF and DC power sources. The ion funnel enhances ion acceptance by having a large input aperture tapering to an exit, which focuses the ions effectively at the exit (e.g., the location of the conductance limit). However, it was realized that RF potentials on ring electrodes of the ion funnel create an effective potential barrier which prevents low mass-to-charge ratio (m/z) ion transmission into the next vacuum stage (R. D. Smith et al., "Characterization of an Improved Electrodynamic Ion Funnel Interface for Electrospray Ionization Mass Spectrometry", Analytical Chemistry, vol. 71, pp. 2957-2964 (1999)) The value of the effective potential in adiabatic approximation can be determined by equation (1):

$$V^*(r, z) = \frac{qE_{rf}^2(r, z)}{4m\omega^2} \tag{1}$$

where $E_{rf}(r,z)$ is the absolute value of the RF electric field, $\omega=2\pi f$ is the angular frequency, m is mass, and q is charge. Referring to FIG. 1, the results of effective potential calculations on an ion funnel central axis are provided. The RF potential applied to ring electrodes was 50 $V_{0\text{-}p}$ and the frequency was 2 MHz for the calculations. As shown, the effective potential increases with decreasing ring diameter and reaches 4.5 V and 9.0 V for m/z=100 and 50, respectively, at the last ion funnel electrode (1.4 mm diameter for these calculations). The corresponding effective electric field calculated on the central ion funnel axis is shown in FIG. 2. The electric field was calculated by dividing the effective potential difference between adjacent points by the distance between the points.

To circumvent the problem of low m/z transmission in the ion funnel, it was proposed to have the last funnel electrode with a diameter of 2.0 mm or bigger (R. D. Smith et al., "Theoretical and Experimental Evaluation of the Low m/z Transmission of an Electrodynamic Ion Funnel", J Am Soc. Mass Spectrom, vol. 17, pp. 586-592; A. Mordehai et al., "Optimization of the Electrodynamic Ion Funnel for Enhanced Low Mass Transmission, Proc. of Am. Soc. Mass Spectrom Conf., Salt Lake City, Utah, 2010). However, this proposal provides a sample flow from the ion funnel that is prohibitive for portable systems, which use small pumps to achieve vacuum for ion analysis.

Accordingly, a sample inlet device and methods for use of the sample inlet device are described that include an ion funnel having a plurality of spacer elements disposed coaxially with the plurality of ion funnel electrodes. The spacer elements provide a substantially sealed ion funnel design that enable favorable as dynamics of the sample flow for detection of relatively low m/z ions by a mass analyzer. The spacer elements are positioned proximal to one or two adjacent electrodes, with each of the plurality of spacer elements having an aperture with a diameter that is greater than a diameter of each adjacent electrode. The ion funnel is configured to pass an ion sample through the apertures of the electrodes and the spacer elements to additional portions of a detection system, such as to a mass analyzer system and detector. A process for utilizing the sample inlet device that employs the ion funnel with the spacer elements is provided.

Figure 3:
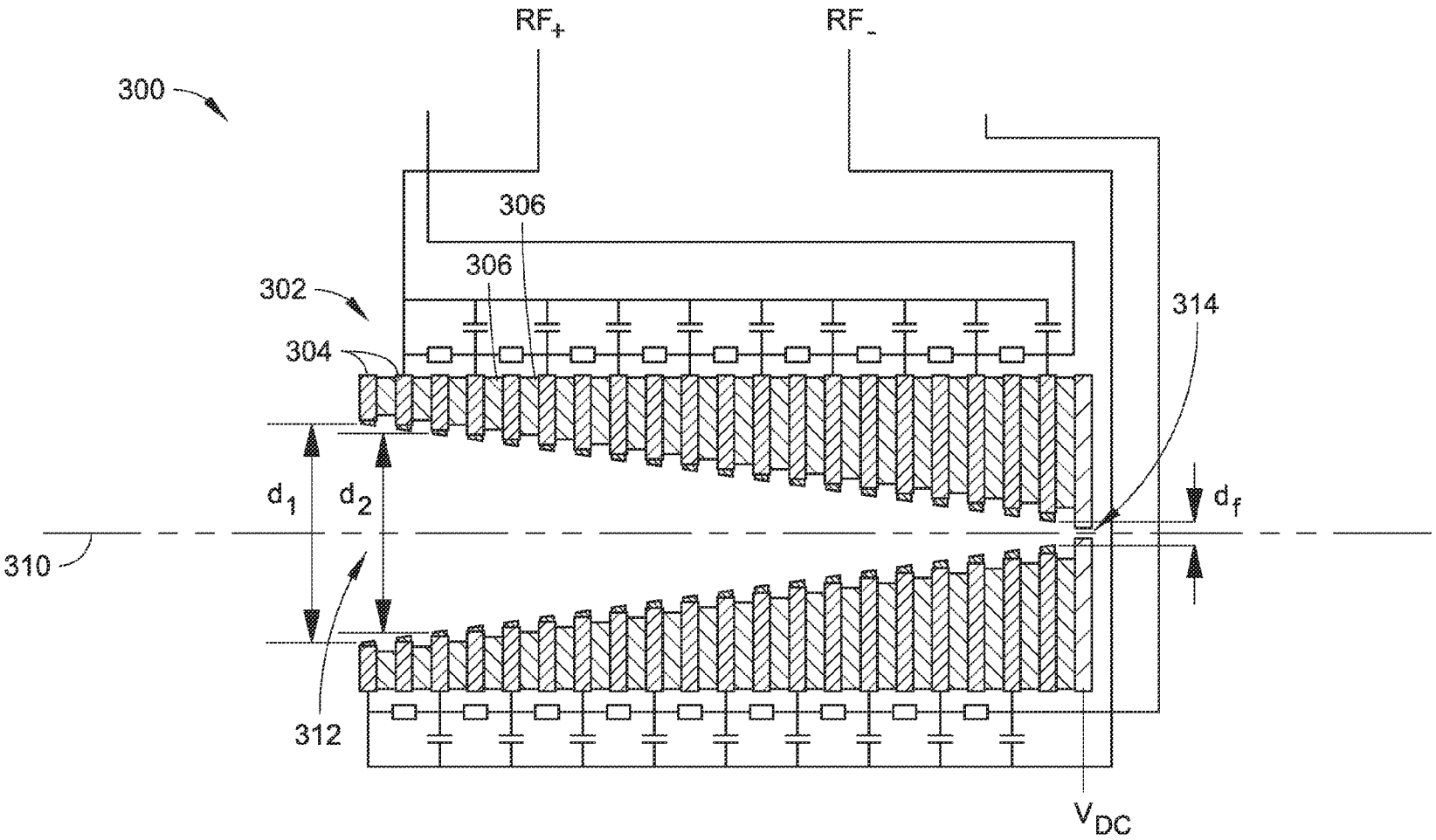
FIG. 3 is a diagrammatic cross-sectional view illustrating a sample inlet device that includes an ion funnel having a plurality of spacer elements disposed coaxially with a plurality of electrodes in accordance with an example implementation of the present disclosure.
Figure 4A:
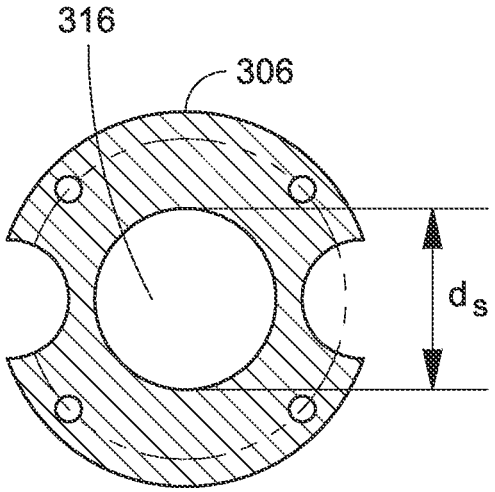
FIG. 4A is a plan view of a spacer element configured for disposal in an ion funnel between adjacent electrode plates in accordance with an example implemanation of the present disclosure.
Figure 4B:
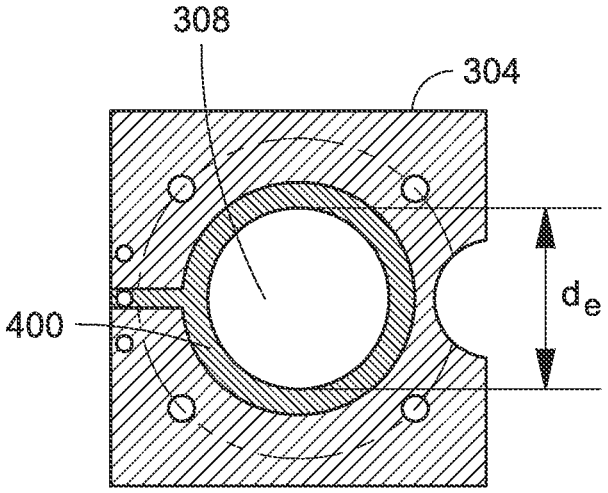
FIG. 4B is a plan view of an electrode plate configured for disposal in an in funnel in accordance with an example implementation of the present disclosure.

FIG. 3 illustrates a sample inlet device 300 in accordance with example implementations of the present disclosure. As shown, the sample inlet device 300 includes an ion funnel 302 configured to receive an ion sample from a sample ionizing source. The ion funnel 302 includes a plurality of electrodes 304 (e.g., electrode plates, as shown in FIG. 4B) and a plurality of spacer elements 306 (e.g., as shown in FIG. 4A). In implementations, the electrodes 304 define apertures 308 arranged about an axis 310 extending from an inlet 312 of the ion funnel 302 to an outlet 314 of the ion funnel 302. For example, the axis 310 is directed through the center of the aperture 308 of each of the electrodes 304. The size of the apertures 308 is gradually decreased or tapered from the inlet 312 of the ion funnel 302 to the outlet 314 of the ion funnel 302 along axis 310. In order to contain or funnel the ion sample through the ion funnel 302, out of phase radio frequency (RF) potentials are applied to adjacent electrodes 304. The applied RF potentials create an effective potential which confines ions radially through the apertures 308 and 316 in the presence of a buffer gas. A direct current (DC) axial electric field gradient is applied to the ion funnel 302 to facilitate movement of the ions toward the outlet 314 of the ion funnel 302, along the axis 310.

The electrodes 304 can be manufactured from printed circuit boards and thus can include a printed circuit board material. The electrodes can also include resistors and conductors (shown in FIG. 3) mounted on the printed circuit board material. In implementations, the electrodes 304 can include an aperture 308 bordered by a conductive layer or coating 400. The conductive coating 400 can cover the inner rim of the aperture 308, as well as the front and back surfaces around the aperture. The ion funnel 302 can include spring pins to make connections between the electrodes 304.

The spacer elements 306 are positioned proximate the electrodes 304 in the ion funnel 302. In implementations, the spacer elements 306 are disposed coaxially with the plurality of electrodes 304. For example, the spacer elements 306 define apertures 316 arranged about the axis 310, such that the axis 310 is directed through the center of the aperture 316 of each of the spacer elements 306. Each of the spacer elements 306 is positioned proximal to one or two adjacent electrodes 304, depending on whether the spacer element 306 is a terminal element proximate the outlet 314 within the ion funnel 302 (where the spacer element 306 could be positioned adjacent to one electrode 304) or an internal element (where the spacer element 306 would be position between two electrodes 304).

In exemplary implementations, the apertures 308 of the electrodes 304 and the apertures 316 of the spacer elements 306 have a generally circular shape, where the apertures 308 have a diameter $d_e$ (FIG. 4B) and the apertures 316 have a diameter $d_s$ (FIG. 4A). The shape of the apertures 308 depends on the particular design considerations of the ion funnel 302, the electrodes 304, and so forth, and thus can have shapes other than circular, such as rectangular, irregular, and so forth. In an implementation, the diameters $d_e$ of the apertures 308 incrementally decrease or taper from the inlet 312 of the ion funnel 302 to the outlet 314 of the ion funnel 302 along axis 310. The dimensions of the apertures 308 and 316 depend on the particular design considerations of the ion funnel 302, such as the particular operating environment of the sample inlet device 300. For example, in an implementation, the aperture 308 of the electrode 304 nearest the inlet 312 of the ion funnel 302 has a diameter ($d_1$ as shown in FIG. 3) of approximately 21 millimeters, where the diameter $d_e$ incrementally decreases by 0.5 millimeters for each electrode 304 along axis 310 (e.g., $d_2$ in FIG. 3 is approximately 20.5 mm), where the aperture 308 of the electrode 304 nearest the outlet 314 of the ion funnel 302 has a diameter ($d_f$ as shown in FIG. 3) of approximately 1.0 millimeters. In implementations, the aperture 308 of the electrode 304 nearest the outlet 314 of the ion funnel 302 can have a diameter ($d_f$ as shown in FIG. 3) of less than 2.0, such as a diameter of between approximately 1.5 millimeters and 1.0 millimeters, or another diameter as dictated by the particular ion funnel characteristics. The apertures 316 of the spacer elements 306 are configured to permit passage of the ion sample through the spacer elements 306 without impeding the flow into the subsequent electrodes 304. Accordingly, the diameter $d_s$ of the aperture 316 of a particular spacer element 306 is greater than the diameter $d_e$ of the aperture 308 of each respective adjacent electrode 304, such that the flow through the adjacent electrodes 304 is not impeded by the size of the diameter $d_s$ of the aperture 316 of the spacer element 306.

The spacer elements 306 may be formed from flexible materials to facilitate forming a gas-tight interface between the spacer elements 306 and adjacent electrodes 304. For example, in implementations the spacer elements 306 are formed from polytetrafluoroethylene. The gas-tight interface may extend throughout the ion funnel 302 by orienting the spacer elements 306 relative to the electrodes 304 in an interleaved manner, such as that shown in FIG. 3.

Figure 5:
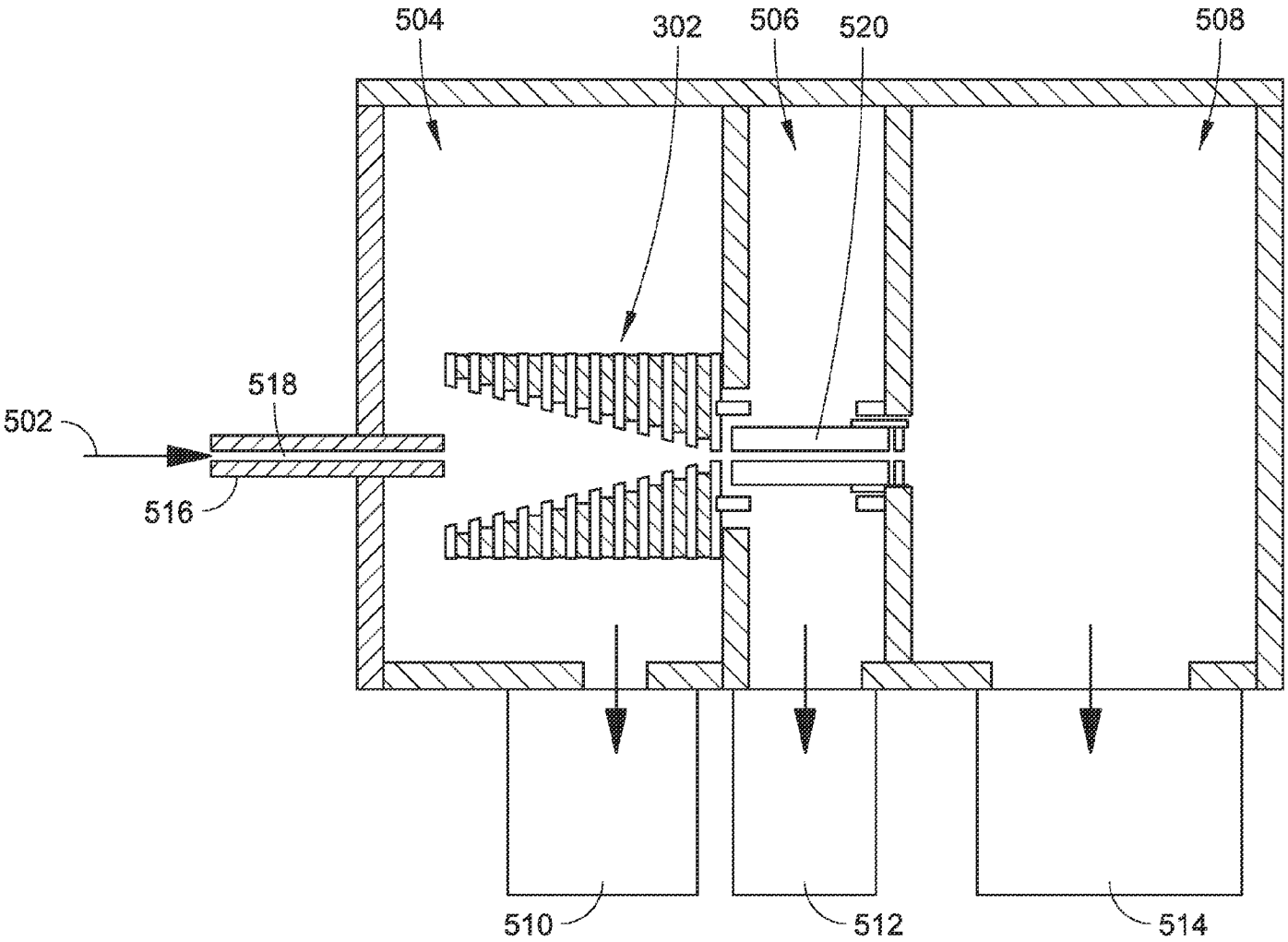
FIG. 5 is a diagrammatic cross-sectional view illustrating a sample detection device in accordance with an example implementation of the present disclosure.

Referring to FIG. 5, a sample detection system 500 is shown. The sample detection system 500 includes a sample ionizing source 502, a sample inlet portion 504, an ion guide portion 506, and a mass analyzer portion 508. The sample inlet portion 504, the ion guide portion 506, and the mass analyzer portion 508 are maintained at sub-atmospheric pressures. In implementations, a differential pressure system is provided by three pumping stages, one for each of the sample inlet portion 504, the ion guide portion 506, and the mass analyzer portion 508. For example, in an implementation, a low vacuum pump 510 (e.g., a diaphragm pump) is utilized to reduce the pressure of the sample inlet portion 504, a drag pump 512 is utilized to reduce the pressure of the ion guide portion 506 to a pressure lower than the sample inlet portion 504, and a high vacuum pump 514 (e.g., a turbomolecular pump) is utilized to reduce the pressure of the mass analyzer portion 508 to a pressure lower than the ion guide portion 506. In a specific implementation, the low vacuum pump 510 provides a vacuum of up to approximately 30 Torr (e.g., for a vacuum chamber that includes the ion funnel 302), particularly between 5 and 15 Torr the drag pump 512 provides a vacuum of between approximately 0.1 and 0.2 Torr, and the high vacuum pump provides a vacuum of between approximately $10^{-3}$ and $10^{-4}$ Torr, although the low vacuum pump 510, the drag pump 512, and the high vacuum pump 514 may provide other vacuum pressures as well. Moreover, while three pumps are shown, the sample detection system 500 may include fewer or additional pumps to facilitate the low pressure environments.

The sample inlet portion 504 includes a conduit 516 and an ion funnel 302. The conduit 102 may include a capillary tube, which may or may not be heated. In embodiments, the conduit 102 may have a constant diameter (e.g., a planar plate or cylinder. The conduit includes a passageway 518 configuration to pass an ion sample from the sample ionizing source 502 to the inlet 312 of the ion funnel 302. The sample ionizing source 502 can include an atmospheric pressure ionization (API) source, such as an electrospray (ES) or atmospheric pressure ionization (APCI) source, or other suitable ion source. In embodiments, sizing of the passageway 518 includes dimensions that allow a sample of ions and/or a carrier gas to pass while allowing a vacuum chamber (e.g., a portion of the mass spectrometer) to maintain proper vacuum. The ion funnel 302 may function to focus the ion beam (or ion sample) into a small conductance limit at the outlet 314 of the ion funnel 302. In some embodiments, the ion funnel 302 operates at relatively high pressures (e.g., between 5 and 15 Torr) and thus provides ion confinement and efficient transfer into the next vacuum stage (e.g., ion guide portion 506) or subsequent stages, which are at relatively lower pressures. The ion sample may then flow from the ion funnel 302 into an ion guide 520 of the ion guide portion 506.

In implementations, the ion guide 520 serves to guide ions from the ion funnel 302 into the mass analyzer portion 508 while pumping away neutral molecules. In some embodiments, the ion guide 520 includes a multipole ion guide, which may include multiple rod electrodes located along the ion pathway where an RF electric field is created by the elect/odes and confines ions along the ion guide axis. In some embodiments, the ion guide 520 operates between approximately 0.1 and 0.2 Torr pressure, although other pressures may be utilized. The ion guide 520 is followed by a conductance limiting orifice.

In implementations, the mass analyzer portion 508 includes the component of the mass spectrometer (e.g., sample detection device 500) that separates ionized masses based on charge to mass ratios and outputs the ionized masses to a detector. Some examples of a mass analyzer include a quadrupole mass analyzer, a time of flight (TOF) mass analyzer, a magnetic sector mass analyzer, an electrostatic sector mass analyzer, a quadrupole ion trap mass analyzer, and so forth.

Figure 6:
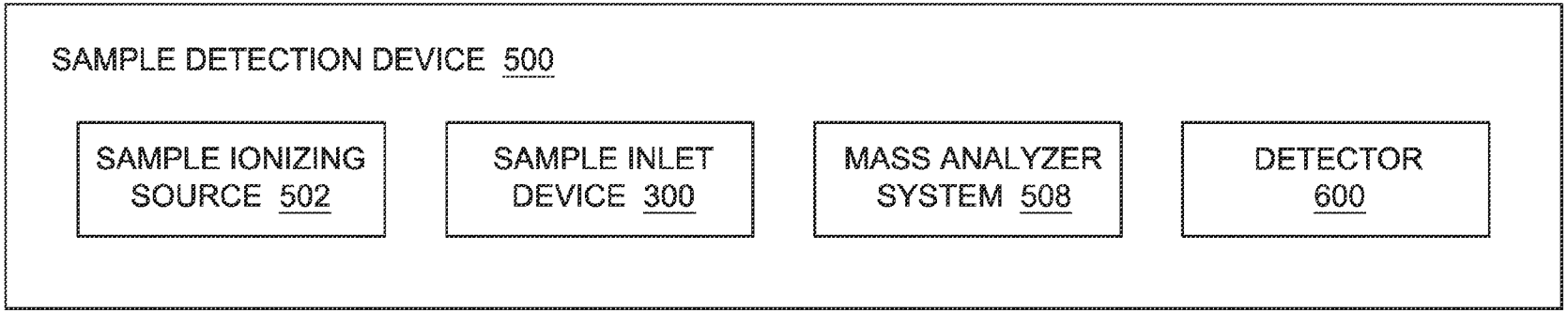
FIG. 6 is as block diagram illustrating a sample detection device that includes a sample ionizing source, a sample inlet device, a mass analyzer system, and a detector in accordance with an example implementation of the present disclosure.

FIG. 6 illustrates one example of a sample detection device 500 including a sample ionizing source 502, a sample inlet device 300, a mass analyzer system 508, and a detector 600. In embodiments, a sample ionizing source 502 may include a device that creates charged particles (e.g., ions). Some examples of on sources may include an electrospray ion source, an inductively-coupled plasma, a spark ion source, a corona discharge ion source, a radioactive ion source (e.g., $^{63}$Ni or $^{241}$Am), and so forth. Additionally, a sample ionizing source 502 may generate ions from a sample at about atmospheric pressure. A sample inlet device 300 includes an ion funnel, such as the ion funnel 302 described in the preceding paragraphs. Likewise, a mass analyzer system 508 can include systems similar to those described above. A detector 600 can include a device configured to record either the charge induced or the current produced when an ion passes by or contacts a surface of the detector 600. Some examples of detectors 600 include electron multipliers, Faraday cups, ion-to-photon detectors, and so forth.

As described, the spacer elements 306 of the ion funnel 302 can facilitate forming a gas-tight interface between the spacer elements 306 and adjacent electrodes 304. Accordingly, the fluid flow is constrained through the apertures 308 and 316 of the electrodes 304 and the spacer elements 306, respectively. The gas-tight arrangement of the ion funnel 302 provides desirable gas dynamic effects to overcome the effective RF potential barrier for low m/z ions at the outlet 314 of the ion funnel 302, were the internal diameter of electrodes is relatively small. Because of the large pressure difference between the sample inlet portion 504 and the next vacuum stage (e.g., the ion guide portion 506), which can be a differential of more than 2 orders of magnitude, a relatively high-speed gas flow (e.g., approximately 300 m/s in various implementations) is created at the outlet 314 of the ion funnel 302. The number of collisions of ions with gas molecules is directly proportional to gas pressure and increases with increasing pressure. To estimate the gas dynamic effect on ion motion, the following relation can be used:

$$E^*_g \sim v/K \quad (2)$$

where v is gas velocity, and K is ion mobility coefficient of the considered ion.

Figure 7:
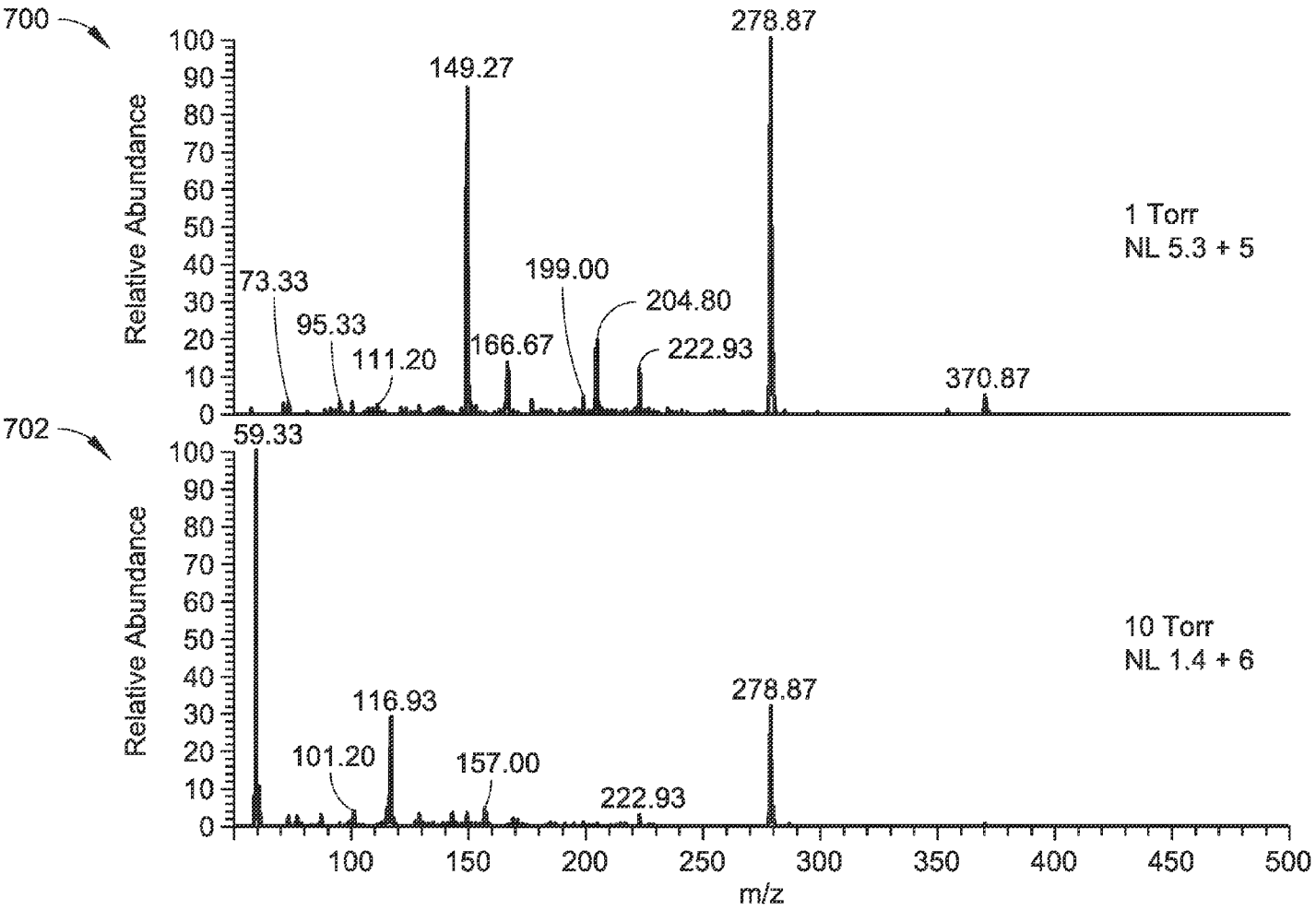
FIG. 7 is a chart of two graphs show relative abundance of various ions measured after passing through an ion funnel at two different pressures, in accordance with example implementations of the present disclosure.

For values of v=300 m/s or $3\cdot10^4$ cm/s and $K_0$=2.0 $cm^2$/V/s, $E^*_g$ is estimated as 20 V/cm at 1 Torr and 200 V/cm at 10 Torr. The effective RF electric field gradient (example data is shown FIG. 1) is of the order of 200 V/cm for m/z=50 and 100 V/cm for m/z=100. These estimates demonstrate that at larger pressures (e.g., approximately 10 Torr) the gas dynamic effects become comparable with RF field gradients and thus allow efficient transmission of low m/z ions into the next vacuum stage. Referring to FIG. 7, two graphs (700 at the top, 702 at the bottom) showing relative abundance of various ions measured by a mass spectrometer after passing through a gas-tight structured ion funnel (such as those described herein) at two different pressures are shown. To generate graphs 700 and 702, an atmospheric pressure chemical ionization source was used to generate ions from air containing acetone vapors. The diameter of the narrowest aperture of the ion funnel electrodes was 1.0 mm, with an RF voltage of 50 $V_{0\text{-}p}$. The ion funnel pressure used to generate graph 700 was 1 Torr with a normalized intensity (NL) of $5.3\times10^5$, whereas the ion funnel pressure used to generate graph 702 was 10 Torr, with an NL of $1.4\times10^6$. All other mass spectrometer parameters (e.g., pressure in the next vacuum section after the ion funnel) were kept the same between experiments. As can be seen, the transmission of low m/z ions is greatly improved with increasing pressure in the ion funnel due to as dynamic effects. For instance, the transmission of ions with an m/z of 116.93, 101.20, and 59.33 are readily apparent in graph 702, but lacking in graph 700. The transmission of high m/z ions remains stable (e.g., there may be a factor of 2 reduction for some ions). The small exit ion funnel plate diameter reduces the gas flow into the next vacuum section, thus allowing use of small vacuum pumps.

Figure 8:
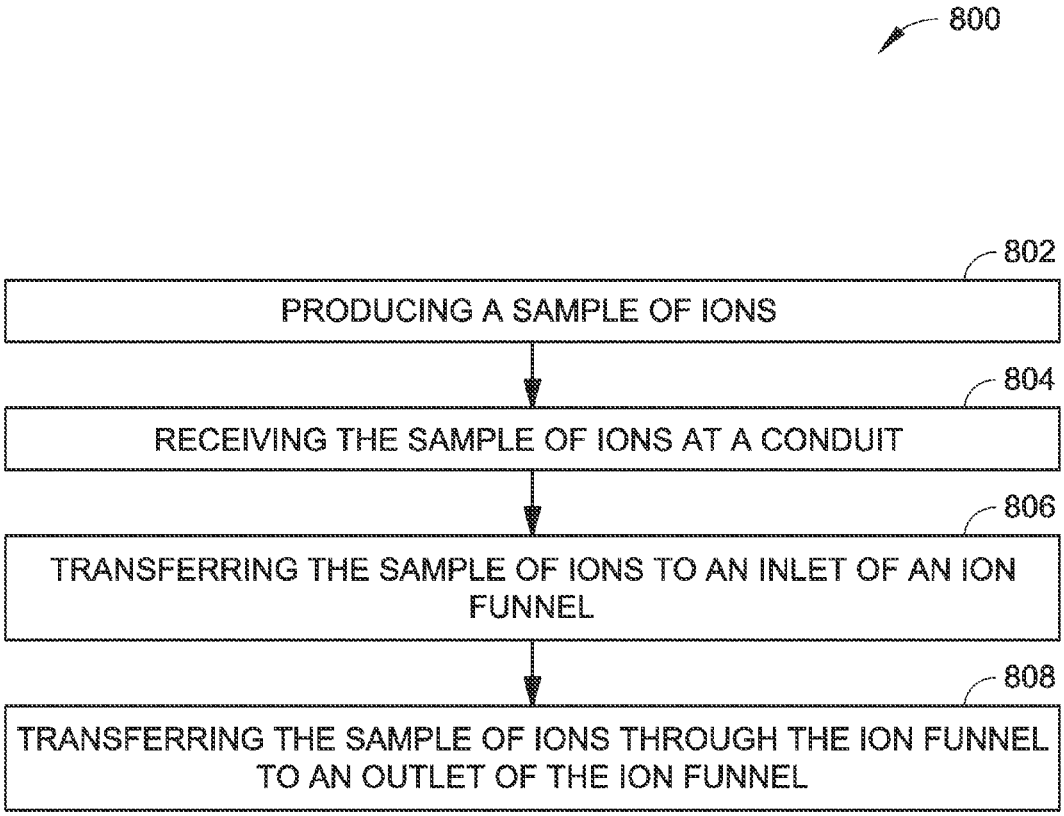
FIG. 8 is a flow diagram illustrating an example process for utilizing the sample inlet device and sample detection device illustrated in FIGS. 3 through 6.

FIG. 8 illustrates an example process 800 that employs the disclosed techniques to employ a sample detection device, such as the sample detection device 500 shown in FIGS. 3 through 6.

Accordingly, a sample of ions is produced (Block 802). In implementations, producing a sample of ions can include, for example, using an ion source (e.g., electrospray ionization, inductively-coupled plasma, spark ionization, a corona source, a radioactive source (e.g., 63Ni), etc.) or electromagnetic device to produce the ions. In one embodiment, producing a sample of ions includes using a sample ionizing source 502, such as a corona discharge ion source. A corona discharge ion source utilizes a corona discharge surrounding a conductor to produce the sample of ions. In another embodiment, electrospray ionization is used to produce a sample of ions. Electrospray ionization may include applying a high voltage to a sample through an electrospray needle, which emits the sample in the form of an aerosol. The aerosol then traverses the space between the electrospray needle and a cone while solvent evaporation occurs, which results in the formation of ions.

The sample of ions is received at a capillary (Block 804). In implementations, an on sample is produced by sample ionizing source 502 and received at a conduit 516. In one embodiment, an ion sample is created using an electrospray source and received at a heated capillary 516, which then travels through the heated capillary 516.

The sample of ions is transferred to an inlet of an ion funnel (Block 806). In implementations, an ion funnel 302 includes an inlet 312 configured to receive a sample of ions from the capillary 516. The ion funnel 302 includes a plurality of electrodes 304 with apertures 308 arranged about an axis 310 extending from the inlet 312 of the ion funnel 302 to an outlet 314 of the ion funnel 302, and includes a plurality of spacer elements disposed coaxially with the plurality of electrodes. In implementations, the electrodes 304 and the spacer elements 306 are disposed in an interleaved configuration to facilitate gas-tight interfaces between the electrodes 304 and the spacer elements 306, thereby constraining fluid flow through the apertures 308 and 316 of the electrodes 304 and the spacer elements 306, respectively. The gas-tight structure of the ion funnel 302 can result in desirable gas dynamic flow to facilitate transfer of low m/z ions from the ion funnel 302 to a mass analyzer system 508 while utilizing portable vacuum pump systems. The sample of ions is transferred through the ion funnel to an outlet of the ion funnel (Block 808).

Although the invention has been described in language specific to structural features and/or methodological acts, it is to be understood that the invention defined in the appended claims is not necessarily limited to the specific features or acts described. Although various configurations are discussed the apparatus, systems, subsystems, components and so forth can be constructed in a variety of ways without departing from this disclosure. Rather, the specific features and acts are disclosed as example forms of implementing the claimed invention.

What is claimed is:

1. A mass spectrometry sample inlet device for transmission of ions generated at near atmospheric conditions, comprising:

an ion funnel configured to receive an ion sample from a sample ionizing source, the ion funnel including:

a plurality of electrodes with apertures configured for passage of sample ions arranged along a common axis extending from an inlet of the ion funnel to an outlet of the ion funnel, each electrode of the plurality of electrodes is connected to a corresponding RF potential, and the RF potential applied to respective ones of the plurality of electrodes is out of phase from the RF potential applied to adjacent electrodes; and a plurality of spacer elements disposed coaxially with the plurality of electrodes, at least one of the plurality of spacer elements being positioned between two adjacent electrodes to provide an at least partially gas-tight structure, so that gas cannot escape between the at least one spacer element and the adjacent electrodes, the at least partially gas tight structure configured to create an axial gas dynamic flow at the outlet of the ion funnel.

2. The mass spectrometry sample inlet device of claim 1, wherein the ion funnel further comprises a DC potential gradient along the axis via application of a DC potential to at least one of the electrodes.

3. The mass spectrometry sample inlet device of claim 1, wherein respective ones of the plurality of spacer elements define an aperture having a diameter, the diameter being greater than diameters of the apertures of adjacent electrodes.

4. The mass spectrometry sample inlet device of claim 1, wherein at least one of the plurality of spacer elements comprises polytetrafluoroethylene.

5. The mass spectrometry sample inlet device of claim 1, wherein the electrode positioned nearest the outlet of the ion funnel defines an internal aperture having a diameter of approximately 1.0 millimeters.

6. The mass spectrometry sample inlet device of claim 1, wherein at least one of the plurality of electrodes includes a printed circuit board material.

7. The mass spectrometry sample inlet device of claim 6, wherein at least one of the plurality of electrodes includes one or more resistors and one or more capacitors mounted on the printed circuit board material.

8. The mass spectrometry sample inlet device of claim 6, further comprising one or more spring pins connecting the plurality of electrodes.

9. The mass spectrometry sample inlet device of claim 1, wherein at least one of the plurality of electrodes includes an aperture bordered by a conductive coating.

10. The mass spectrometry sample inlet device of claim 1, further comprising a capillary configured to introduce the ion sample to the inlet of the ion funnel.

11. The mass spectrometry sample inlet device of claim 1, wherein the plurality of spacer elements is positioned in an interleaved configuration relative to the plurality of electrodes.

12. The mass spectrometry sample inlet device of claim 9, wherein the conductive coating covers an inner rim of the aperture.

13. A sample detection system, comprising:

a sample ionizing source;

a sample inlet configured to receive an ion sample from the sample ionizing source, the sample inlet including: an ion funnel including:

a plurality of electrodes with apertures configured for passage of sample ions arranged along a common axis extending from an inlet of the ion funnel to an outlet of the ion funnel, each electrode of the plurality of electrodes is connected to a corresponding RF potential, and the RF potential applied to respective ones of the plurality of electrodes is out of phase from the RF potential applied to adjacent electrodes; and a plurality of spacer elements disposed coaxially with the plurality of electrodes, at least one of the plurality of spacer elements being positioned between two adjacent electrodes to provide an at least partially gas-tight structure so that gas cannot escape between the at least one spacer element and the adjacent electrodes, the at least partially gas tight structure configured to create an axial gas dynamic flow at the outlet of the ion funnel; and a capillary positioned adjacent the inlet of the ion funnel to direct the ion sample into the ion funnel; and a mass analyzer system including a vacuum chamber.

14. The sample detection system of claim 13, wherein respective ones of the plurality of spacer elements define an aperture having a diameter, the diameter being greater than diameters of the apertures of adjacent electrodes.

15. The sample detection system of claim 13, wherein at least one of the plurality of spacer elements comprises polytetrafluoroethylene.

16. The sample detection system of claim 13, wherein the electrode positioned nearest the outlet of the ion funnel defines an internal aperture having a diameter of approximately 1.0 millimeters.

17. The sample detection system of claim 13, wherein the capillary is a heated capillary.

18. The sample detection system of claim 13, wherein the plurality of spacer elements is positioned in an interleaved configuration relative to the plurality of electrodes.

19. A method for collecting ions into a sample detection system, comprising:

producing a sample of ions from an ion source;

receiving the sample of ions at a capillary;

transferring the sample of ions from the capillary to an inlet of an ion funnel, the ion funnel including:

a plurality of electrodes with apertures arranged about an axis extending from an inlet of the ion funnel to an outlet of the ion funnel; and a plurality of spacer elements disposed coaxially with the plurality of electrodes, each of the plurality of spacer elements being positioned proximal to one or two adjacent electrodes to provide an at least partially gas-tight structure so that gas cannot escape between each of the plurality of spacer elements and each respective adjacent electrode; and transferring the sample of ions through the ion funnel to the outlet of the ion funnel.

20. The method of claim 19, wherein transferring the sample of ions through the ion funnel to an outlet of the ion funnel includes transferring the sample of ions through an aperture of an electrode plate adjacent the outlet, the aperture having a diameter of approximately 1.0 millimeters.

21. The method of claim 19, further comprising transferring the sample of ions from the outlet of the ion funnel to an ion guide.

22. The method of claim 21, further comprising transferring the sample of ions from the ion guide to a mass analyzer.

* * * * *